United States Patent [19]

Gendron et al.

[11] 4,051,000

[45] Sept. 27, 1977

[54] NON-CONTAMINATING ANODE SUITABLE FOR ELECTROWINNING APPLICATIONS

[75] Inventors: Aubrey Stewart Gendron, Lively; Shinichiro Abe, Toronto; Victor Alexander Ettel; Charles Edward O'Neill, both of Mississauga, all of Canada

[73] Assignee: The International Nickel Company, Inc., New York, N.Y.

[21] Appl. No.: 625,899

[22] Filed: Oct. 28, 1975

[30] Foreign Application Priority Data

Nov. 4, 1974 Canada ..... 212965

[51] Int. Cl.[2] ..... C25C 1/12; C25C 1/16; C25C 1/22; C25C 7/02

[52] U.S. Cl. ..... 204/106; 204/112; 204/114; 204/290 F; 204/42

[58] Field of Search ..... 204/290 F, 42, 105 R, 204/106–109, 112–119

[56] References Cited

U.S. PATENT DOCUMENTS

| | | | |
|---|---|---|---|
| 3,207,679 | 9/1965 | Schmidt | 204/42 R |
| 3,213,004 | 10/1965 | Schmidt | 204/29 |
| 3,616,302 | 10/1971 | Osawa et al. | 204/40 |
| 3,850,764 | 11/1974 | Herczog et al. | 204/38 A |
| 3,855,084 | 12/1974 | Feige | 204/38 R |
| 3,880,728 | 4/1975 | Habermann et al. | 204/38 A |

OTHER PUBLICATIONS

Kokhanov et al, Elektrokhimiya vol. 9, No. 1, pp. 30–33 1/73 English Translation Soviet Electrochemistry.

*Primary Examiner*—F.C. Edmundson
*Attorney, Agent, or Firm*—Miriam W. Leff; Ewan C. MacQueen

[57] ABSTRACT

A non-contaminating electrode is provided suitable as an insoluble anode for the electrowinning of metals from an electrolyte solution, said electrode comprising a metal substrate formed of a metal selected from the group consisting of titanium, zirconium, tantalum and alloys thereof, said metal substrate having a flash metal coating of a platinum-group metal thereon, which coating in turn is covered by an intermediate adherent layer of lead dioxide, said lead dioxide layer in turn having an adherent overlayer of manganese dioxide.

14 Claims, No Drawings

NON-CONTAMINATING ANODE SUITABLE FOR ELECTROWINNING APPLICATIONS

This invention relates to insoluble electrodes e.g., insoluble anodes, for use in electrolysis and, in particular, to a lead dioxide anode treated to render said anode non-contaminating in the electrowinning of metals from aqueous solutions, such as solutions obtained in the leaching of ores.

STATE OF THE ART

It is known to use insoluble lead dioxide anodes in the electrolytic production of chlorine, chlorates and perchlorates from aqueous solutions without substantial deterioration of the anode. In this connection, reference is made to U.S. Pat. No. 2,945,791 which discloses the use of lead dioxide-coated graphite as an insoluble anode in the electrolytic production of chlorine.

In U.S. Pat. No. 3,616,302, insoluble anodes are disclosed for use in the electrolytic recovery of metals from aqueous solutions. The patent states that the most important problem is to select a suitable insoluble anode that does not pollute the electrolyte, has a long life and which exhibits low oxygen overvoltage during electrolysis. The patent states that one anode proposed comprised a titanium substrate coated with a thin layer of platinum, the platinum layer having electro-deposited thereon a coating of lead dioxide.

While the characteristics of foregoing insoluble anode were improved somewhat, the anode system exhibited a comparatively high oxygen overvoltage and, moreover, lead tended to carry over to the cathode and deposit out as an impurity with the metal being recovered electrolytically. To overcome this problem, the patent suggests replacing the lead dioxide with manganese dioxide which is somewhat insoluble and is electrically conductive. The patent states that even when the manganese dioxide is dissolved in the electrolyte, it cannot easily be deposited as a reduced product on the cathode. Thus, in essence, manganese does not pollute the electrolyte as lead dioxide does. In addition, manganese exhibits a low oxygen overvoltage as an insoluble anode during electrolysis and, moreover, aids in economizing electric power necessary for electrolysis. However, the patent points out that it is desirable to use thin layers of manganese dioxide (e.g. 10 to 100 microns). If, for example, the thickness is greater than 100 microns, the internal stress of the layer tends to increase so as to cause the layer to be detached. If the thickness is less than 10 microns, oxygen evolves on the surface of the thin layer which contains a basic composition of the intermediate platinum-group metal coating which results in a passive oxide film on the surface of the substrate material. The thin layer of manganese dioxide is also desirable to reduce voltage losses because of the limited electrical conductivity of the oxide. However, the life of the insoluble anode with the thin manganese dioxide is limited, although this system is an improvement over the titanium-platinum-$PbO_2$ anode system in other respects.

There is considerable economic incentive to develop improved insoluble anodes. For example, in the electrowinning of nickel from aqueous solutions, lead alloy anodes have been estimated to cost 0.3 to 0.4 cents per pound of nickel produced at a current density of 3 amps/dm$^2$. However, the use of this anode requires removal of lead from the electrolyte to minimize the amount of contamination of the deposited nickel. Currently available alternatives such as noble metal coated titanium anodes are known to be many times more expensive than lead alloy anodes.

It would be desirable to provide a non-contaminating insoluble anode which has the economic advantages of the lead alloy anode, which is stable under conditions of electrolysis in the electrowinning of metals from solutions and which is capable of use for a prolonged period of time.

We have now developed a non-contaminating, insoluble, long-life anode which has the low cost advantages of the lead alloy anode and which uses lead dioxide as one of the components without the accompanying disadvantages thereof.

OBJECTS OF THE INVENTION

It is thus the object of the invention to provide as an article of manufacture a non-contaminating insoluble electrode which is not materially consumed during electrolysis and which has good electrical properties.

Another object is to provide an insoluble anode in which lead dioxide is one of the anode components and which is inhibited from polluting the electrolyte.

A further object of the invention is to provide an insoluble anode utilizing a metal substrate selected from the group consisting of titanium, zirconium, tantalum and alloys thereof characterized by a flash coating of a platinum-group metal and an overlayer of a duplex metal oxide coating, one of which is lead dioxide and the other of which is manganese dioxide, the lead dioxide coating being intermediate the platinum-group metal layer and said manganese dioxide layer.

A still further object of the invention is to provide a method of electrowinning metals from aqueous solutions using a non-contaminating insoluble anode.

These and other objects will more clearly appear when taken in conjunction with the following disclosure and the appended claims.

THE INVENTION

Stating it broadly, one embodiment of the invention is directed to an article of manufacture comprising a non-contaminating insoluble anode suitable for use in the electrowinning of metals from aqueous solutions, said anode comprising a metal substrate formed of a metal selected from the group consisting of titanium, zirconium, tantalum and alloys thereof, said metal substrate having a flash metal coating of a platinum-group metal thereon, said coated substrate being in turn covered by a duplex metal oxide coating comprising essentially an intermediate layer of lead dioxide adhering to said platinum-group metal coating and an overlayer of manganese dioxide adhering to said lead dioxide layer.

Another embodiment of the invention is directed to a method of electrowinning a metal, for example, a metal selected from the group consisting of nickel, copper, cobalt and zinc, from an aqueous electrolyte using the non-contaminating insoluble anode of the invention, the method comprising establishing an electrowinning cell containing an insoluble non-contaminating anode and an insoluble cathode immersed in said electrolyte, said non-contaminating anode comprising a metal substrate formed of a metal selected from the group consisting of titanium, zirconium, tantalum and alloys thereof, said metal substrate having a flash coating of a platinum-group metal thereon, said coating being in turn covered by a duplex metal oxide coating as defined hereinabove, and then passing a current from said metal insoluble anode to said cathode, whereby contamination of metal deposited on said cathode is inhibited.

Thus, the invention enables the use of lead dioxide as a component of the anode structure to protect the metal substrate without substantially contaminating the electrolyte in electrowinning applications. As stated hereinbefore, a conventional lead dioxide anode dissolves at a low but finite rate and tends to saturate the electrolyte with lead which co-deposits with the metal being deposited.

The protection of lead dioxide substrate with a compact, adherent coating of manganese dioxide in accordance with the invention inhibits the dissolution of lead and thus prevents the co-deposition of lead on the cathode. As stated hereinbefore, the manganese dioxide is substantially non-contaminating because, even if the manganese dissolves in the electrolyte, it does not co-deposit with the metal deposited by electrolysis, e.g. the metals nickel, cobalt, copper and zinc.

DETAILS OF THE INVENTION

The thickness of the lead dioxide layer may range from about 50 to about 2000 microns, preferably about 50 to about 1000 microns, and that of the manganese dioxide layer from about 10 to about 1000 microns, preferably about 10 to about 600 microns. The lead dioxide layer may be equal in thickness to the manganese dioxide layer and preferably may be thicker.

The lead dioxide underlayer may be prepared according to methods well known in the art, such as by electrodeposition from a nitrate bath. The manganese dioxide layer may be applied electrolytically, for example, from a sulfate bath or by the repeated thermal decomposition of $Mn(NO_3)_2$ at about 190° C; however, electrodeposition is preferred.

The thickness of the platinum-group metal coating on the substrate may generally range from about 0.01 micron to 1 micron. Advantageously, the platinum-group metal is platinum, palladium, ruthenium, or rhodium, or an alloy consisting predominantly of one or more of such metals.

The metal substrate may be used in various forms as the anode, such as sheet or rod; or the anode may have a foraminous structure, such as titanium mesh (e.g. expanded metal), porous sintered compacts of titanium powder and the like. An advantage of using a foraminous structure is that it provides a large surface area which may be desirable in insoluble anodes for use in electrolysis. However, in many applications, anodes configurated in the shape of rods are particularly preferred. The substrate metal may be used in bulk form or may be present, e.g., as a layer, coating or sheath on another material. It is known, for example, to have a titanium layer on a base metal such as copper or any other metal which is a good electrical conductor but which corrodes in the environment.

In producing the insoluble anode of the invention, the metal substrate is first coated with a flash layer of the platinum-group metal followed by the electrodeposition of lead dioxide and the manganese dioxide thereafter applied to the lead dioxide layer.

The examples which follow are illustrations of the foregoing invention.

EXAMPLE I

A sheet of titanium mesh is sand blasted, treated with Alconox cleaner (a detergent comprising complex organic phosphates and sulfonates marketed by Alconox Inc., New York, N.Y.), degreased with acetone, dipped in boiling concentrated HCl for about 1 to 5 minutes and then plated with a flash coating of platinum to a thickness of about 0.5 micron. The platinum is applied to the titanium sheet electrolytically using a bath containing about 5 grams/liter of platinum as sulfato-dinitro-platinous acid ($H_2Pt(NO_2)_2SO_4$) dissolved in a sulfuric acid solution of pH ranging up to 2, with the titanium sheet arranged as the cathode using an insoluble anode of platinum metal. The plating is carried out at a current density of about 0.5 amp/dm$^2$ (ampere per square decimeter) for about 2 to 3 minutes at 25° to 70° C.

Following the application of platinum, the titanium sheet is washed and 50 microns of $PbO_2$ applied anodically to the titanium substrate at a current density of about 0.5 amp/dm$^2$ at 65° C from a bath containing 300 grams per liter (gpl) of $Pb(NO_3)_2$, 100 ml of concentrated $HNO_3$ per liter of solution and 10 mg/liter of Dowfroth 250 which is a trademark for a wetting agent comprising polypropylene-glycol methyl ether marketed by Dow Chemical Company, Midland, Michigan. Finally, manganese dioxide is applied to lead dioxide as a 50- micron coating by anodic deposition from a bath containing 114 gpl of $MnSO_4.H_2O$, 20 gpl $H_2SO_4$ and 10 mg/liter of Dowfroth 250 at a current density of about 0.04 amp/dm$^2$ at 95° C. To deposit manganese dioxide, a lead alloy cathode was used, and to deposit lead dioxide a stainless steel cathode was used.

An insoluble anode produced as described above was tested in a nickel electrowinning electrolyte containing 40 gpl Ni, 42 gpl $H_2SO_4$ and 5 gpl $H_3BO_3$ at a current density of about 4 amps/dm$^2$ at 55° to 60° C. After 65 days (1560 hours) of electrolysis, the anode polarization was not significantly changed and was about 1650 mV as measured against a saturated calomel electrode, which indicated that the anode was performing satisfactorily. Visual examination of the $MnO_2$ coating showed no evidence of deterioration.

The application of only a thin coating of $MnO_2$ is not sufficient to provide the necessary protection against anodization or attack of the substrate for extended periods, while a coating of $PbO_2$ alone results in the co-deposition of lead with the nickel at the cathode. On the other hand, the use of a duplex coating of $PbO_2$ and $MnO_2$ provides markedly improved results.

EXAMPLE 2

An electrode consisting of titanium rods of 0.63 cm diameter is cleaned and treated as described for the titanium substrate hereinbefore discussed in Example 1 and the substrate then plated with platinum from the bath mentioned hereinbefore at a current density of about 0.5 amp/dm$^2$ at a temperature of about 25° to 70° C to produce a flash thickness of platinum of about 0.1 micron. The platinum-coated titanium substrate is then coated with $PbO_2$ in an electrolyte containing 200 gpl $Pb(NO_3)_2$, 100 ml of concentrated $HNO_3$ per liter of solution and about 10 mg/liter of Dowfroth 250. Using a stainless steel cathode and the titanium substrate as the anode, the electrolysis is carried out for a time to produce a lead dioxide thickness of about 100 microns at a current density of about 0.75 amp/dm$^2$ at a temperature falling within the range of about 40° to 70° C.

A layer of manganese dioxide of about 40 microns thick is then applied electrolytically to cover the lead dioxide layer using a bath containing 125 gpl manganese sulfate monohydrate and 20 gpl $H_2SO_4$ at a current density of about 0.03 amp/dm$^2$ at about 90° C. The anode is then ready for use as a substantially non-contaminating insoluble anode.

EXAMPLE 3

Fifteen electrodes are prepared by a method similar to that described in Example 1, using titanium mesh for 4 of the samples and titanium rod for the remainder. Each electrode using titanium rod is prepared with 4 to 6 rods arranged in parallel on a titanium cross bar and each rod is about 5 mm. in diameter by 127 mm. in length. The substrates are flash coated with platinum and have an intermediate coating of lead dioxide 200 to 300 microns in thickness and a surface coating of manganese dioxide of 40 to 60 microns thickness; the lead dioxide being plated at a current density of 0.5 amp/dm$^2$ and the manganese dioxide at 0.02 amp/dm$^2$.

The electrodes are used as insoluble anodes in a nickel electrowinning electrolyte containing:

40–60 gpl nickel
10 gpl boric acid
42 gpl sulfuric acid.
3–5 gpl magnesium ion

The tests are carried out at a current density of about 3 to 5 amps/dm$^2$ and a temperature of 55° to 60° C. The tests were terminated when the anode potential reached 2 volts, and for the purposes of this series of tests this was considered failure. Nine failed to reach 3,000 hours. However, six of the anodes exhibited a life of over 8,400 hours, the tests being interrupted for reasons other than failure. Of these six anodes, two (rod type) ran for about 11,800 hours, two (rod type) about 9,700 hours, one (rod type) over 8,800 hours, and one (mesh type) for about 14,600 hours.

These anodes compare favorably with twenty-seven electrodes tested under similar conditions, but having only a manganese dioxide coating of 40 to 100 microns thickness on the flash coating of platinum. Of the 27 anodes tested the average life was 2,600 hours with a standard deviation of 1,300 hours. Seventeen anodes of this type failed to reach 3,000 hours. The maximum life was 8,378 hours and that was for only one sample.

It will be appreciated that the superior life of the electrodes of the present invention as shown by this statistical study can further be improved, e.g. by applying thicker coatings. Apart from their longer life, anodes of the present invention are superior to anodes having only a manganese dioxide coating in that lead dioxide is more easily deposited than manganese dioxide on the substrate material, the manganese dioxide is more easily deposited on lead dioxide than on the substrate material, and manganese dioxide can be readily recoated on lead dioxide making reconditioning of the anode relatively simple.

As indicated above the lead dioxide and manganese dioxide coating may be prepared by any suitable method. In preparing the lead dioxide coating electrolytically from a lead nitrate electrolyte, suitably, the lead nitrate electrolyte may range in composition from about 100 to 300 gpl $Pb(NO_3)_2$ and about 20 to 200 ml of concentrated $HNO_3$ per liter, with the current density ranging from about 0.1 to 5 amps/dm$^2$ over a temperature range of about 40° to 70° C to produce lead dioxide thicknesses ranging from about 50 to 1000 microns. In preparing the manganese dioxide coating, suitably, the manganese electrolyte may contain, for example, manganese sulfate with free sulfuric acid. The bath may comprise, for example, about 100 to 150 gpl $MnSO_4$ and 10 to 30 gpl $H_2SO_4$. The current density may range from about 0.01 to 0.8 amp/dm$^2$ at temperatures ranging from about 80° to 100° C to produce thicknesses ranging from about 10 to 600 microns.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. As an article of manufacture, an electrically conductive electrode suitable for use as an insoluble anode in the electrowinning of metals from an electrolyte solution, said electrode comprising a metal substrate formed of a metal selected from the group consisting of titanium, zirconium, tantalum and alloys thereof, said metal substrate having a flash metal coating of a platinum-group metal directly thereon, which coating is covered by an intermediate adherent layer of lead dioxide having a thickness of about 50 to about 2000 microns, said lead dioxide layer in turn having an adherent overlayer of manganese dioxide having a thickness of about 10 to about 1000 microns.

2. The electrode of claim 1, wherein said platinum-group metal is selected from the group consisting of platinum, palladium, ruthenium and rhodium.

3. The electrode of claim 1, wherein the thickness of said platinum-group metal ranges from about 0.01 to 1 micron.

4. The electrode of claim 1, wherein the thickness of lead dioxide layer ranges from about 50 to 1000 microns and the thickness of the manganese dioxide layer ranges from about 10 to 600 microns.

5. The electrode of claim 1, wherein the platinum-group metal is platinum.

6. As an article of manufacture, an electrically conductive electrode suitable for use as an insoluble anode in the electrowinning of metals from an electrolyte solution, said electrode comprising a metal substrate of titanium, said metal substrate having a flash metal coating of a platinum-group metal directly thereon, which coating is covered by an intermediate adherent layer of lead dioxide having a thickness of about 50 to about 2000 microns, said lead dioxide layer in turn having an adherent overlayer of manganese dioxide having a thickness of about 10 to about 1000 microns.

7. The electrode of claim 6, wherein said platinum-group metal is selected from the group consisting of platinum, palladium, ruthenium and rhodium.

8. The electrode of claim 6, wherein said platinum-group metal is platinum.

9. The electrode of claim 7, wherein the platinum-group metal has a thickness of about 0.01 to 1 micron.

10. The electrode of claim 6, wherein the thickness of the lead dioxide layer ranges from about 50 to 1000 microns and the thickness of the manganese dioxide layer ranges from about 10 to 600 microns.

11. A method for electrowinning a metal from the group consisting of nickel, copper, cobalt and zinc from an electrolyte containing one of said metals using an insoluble anode and cathode while inhibiting contamination of said metal deposited on said cathode which comprises.

establishing an electrowinning cell comprising an insoluble non-contaminating anode and an insoluble cathode in said electrolyte, said non-contaminating anode comprising a metal substrate formed of a metal selected from the group consisting of titanium, zirconium, tantalum and alloys thereof, said metal substrate having a flash-coating of a platinum-group metal, and coating being in turn covered by a duplex metal oxide coating comprising essentially an intermediate layer of lead dioxide having a thickness of about 50 to about 2000 microns adhering to said platinum-group metal coating and an overlayer of manganese dioxide having a thickness of about 10 to about 1000 microns adhering to said lead dioxide layer, and then passing a current from said insoluble anode to said cathode, whereby said metal is deposited on said cathode and whereby contamination of metal deposited on said cathode is greatly inhibited.

12. The method of claim 11, wherein the platinum-group metal covering the metal substrate is selected from the group consisting of platinum, palladium, ruthenium and rhodium.

13. The method of claim 11, wherein the platinum-group metal covering the substrate has a thickness of about 0.01 to 1 micron, wherein the intermediate layer of lead dioxide has a thickness of about 50 to 1000 microns and the overlayer of manganese dioxide has a thickness of about 10 to 600 microns.

14. The method of claim 13, wherein the substrate is titanium and the platinum-group metal is platinum.

* * * * *